US009829837B2

(12) United States Patent
Ishikawa et al.

(10) Patent No.: US 9,829,837 B2
(45) Date of Patent: Nov. 28, 2017

(54) TRANSFER APPARATUS, NON-TRANSITORY COMPUTER READABLE MEDIUM, AND IMAGE FORMING APPARATUS INCLUDING SUPPLYING UNIT CONFIGURED TO SUPPLY TRANSFER VOLTAGE

(71) Applicant: FUJI XEROX CO., LTD., Tokyo (JP)

(72) Inventors: Takatoshi Ishikawa, Kanagawa (JP); Ayaka Miyoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/244,560

(22) Filed: Aug. 23, 2016

(65) Prior Publication Data

US 2017/0277083 A1 Sep. 28, 2017

(30) Foreign Application Priority Data

Mar. 23, 2016 (JP) ..... 2016-058590

(51) Int. Cl.
*G03G 15/16* (2006.01)
*G03G 21/20* (2006.01)

(52) U.S. Cl.
CPC ..... *G03G 15/1665* (2013.01); *G03G 21/203* (2013.01)

(58) Field of Classification Search
CPC ..... G03G 15/1665; G03G 15/1675; G03G 21/203
USPC ..... 399/44, 66
See application file for complete search history.

(56) References Cited

U.S. PATENT DOCUMENTS 6,047,144 A * 4/2000 Sasai et al. ..... G03G 15/1675 399/44
6,192,203 B1 * 2/2001 Nishio et al. ..... G03G 15/1675 399/66
8,213,817 B2 * 7/2012 Booth et al. ..... G03G 15/1675 399/44
8,831,452 B2 * 9/2014 Yamada ..... G03G 15/1675 399/66

FOREIGN PATENT DOCUMENTS

JP 9-325625 A 12/1997
JP 10-307490 A 11/1998

* cited by examiner

*Primary Examiner* — William J Royer
(74) *Attorney, Agent, or Firm* — Sughrue Mion, PLLC

(57) ABSTRACT

A transfer apparatus includes a transfer unit, a first detector, a supplying unit, a second detector, and a controller. The transfer unit transfers a toner image onto an object. The first detector detects humidity. The supplying unit supplies, to the transfer unit, a transfer voltage, a setting voltage in a first case, and a setting current in a second case. The second detector detects a current flowing through the transfer unit upon supply of the setting voltage and a voltage across the transfer unit upon supply of the setting current. The controller controls the supplying unit such that, when transfer is performed in the first case, a transfer voltage derived using the setting voltage and the detected current is supplied, and when transfer is performed in the second case, a transfer voltage derived using the setting current and the detected voltage is supplied to the transfer unit.

7 Claims, 9 Drawing Sheets

TRANSFER APPARATUS, NON-TRANSITORY COMPUTER READABLE MEDIUM, AND IMAGE FORMING APPARATUS INCLUDING SUPPLYING UNIT CONFIGURED TO SUPPLY TRANSFER VOLTAGE

CROSS-REFERENCE TO RELATED APPLICATIONS

This application is based on and claims priority under 35 USC 119 from Japanese Patent Application No. 2016-058590 filed Mar. 23, 2016.

BACKGROUND

Technical Field

The present invention relates to a transfer apparatus, a non-transitory computer readable medium, and an image forming apparatus.

SUMMARY

According to an aspect of the invention, there is provided a transfer apparatus including a transfer unit, a first detector, a supplying unit, a second detector, and a controller. The transfer unit transfers a toner image onto an object onto which transfer is to be performed. The first detector detects humidity. The supplying unit supplies a transfer voltage to the transfer unit, supplies a setting voltage to the transfer unit in a case where the humidity detected by the first detector is less than or equal to a threshold in a non-transfer period before the toner image is transferred onto the object onto which transfer is to be performed, and supplies a setting current in a case where the humidity detected by the first detector exceeds the threshold in the non-transfer period. The second detector detects a current flowing through the transfer unit in response to supply of the setting voltage and detects a voltage generated across the transfer unit in response to supply of the setting current. The controller controls the supplying unit such that, when transfer is performed in a case where the humidity detected by the first detector is less than or equal to the threshold, a transfer voltage derived using the setting voltage and the current detected by the second detector is supplied to the transfer unit, and when transfer is performed in a case where the humidity detected by the first detector exceeds the threshold, a transfer voltage derived using the setting current and the voltage detected by the second detector is supplied to the transfer unit.

BRIEF DESCRIPTION OF THE DRAWINGS

Exemplary embodiments of the present invention will be described in detail based on the following figures, wherein.

DETAILED DESCRIPTION

Figure 1:
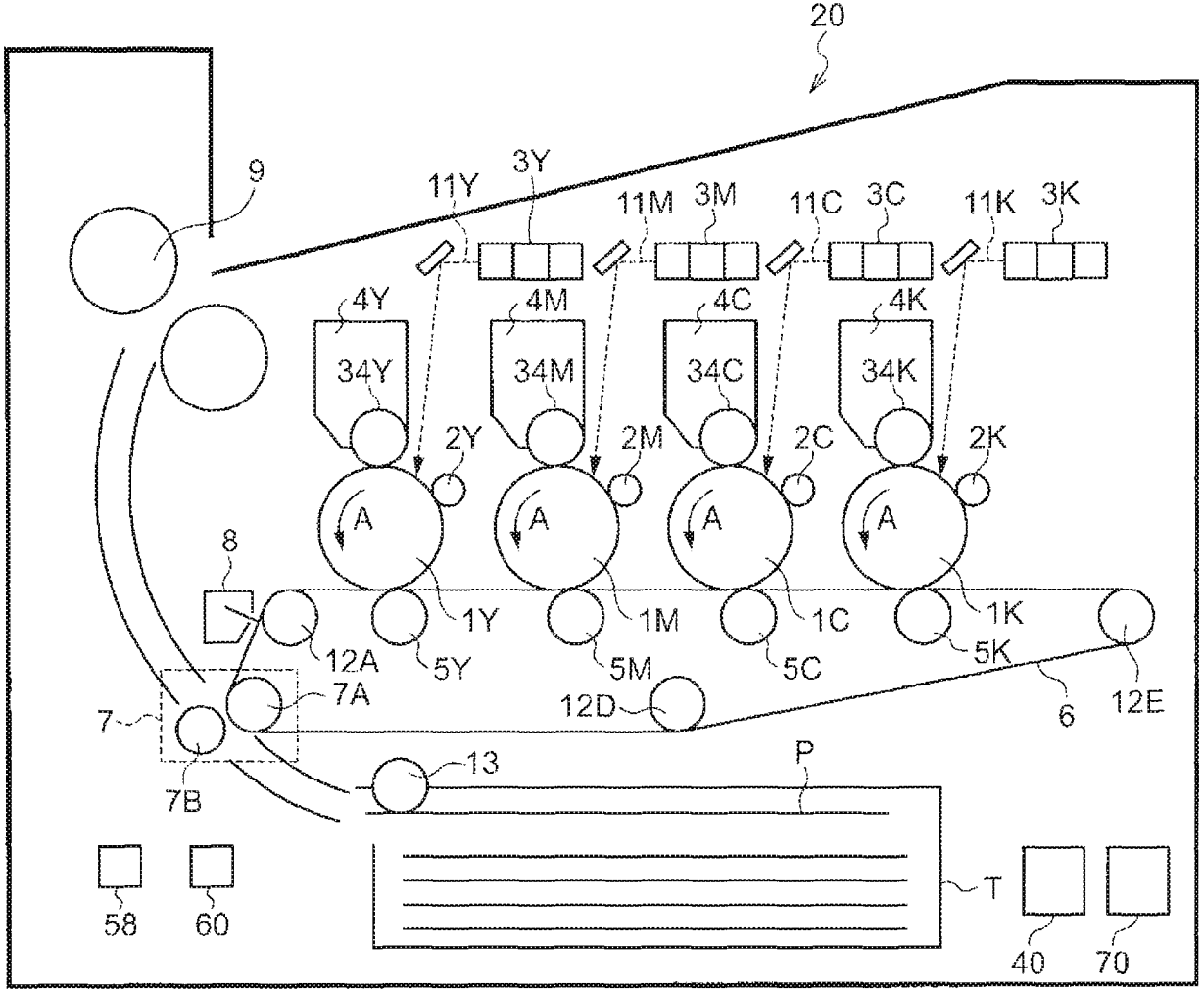
FIG. 1 is a schematic side view illustrating an example of the configuration of a main portion of an image forming apparatus.

In the following, an example of an image forming apparatus according to an exemplary embodiment of the present invention will be described in detail with reference to the drawings. Note that structural elements and processes operating and functioning in the same manner are denoted by the same reference numerals throughout all the drawings, and a redundant description may be omitted as necessary.

First Exemplary Embodiment

FIG. 1 is a schematic side view illustrating the configuration of a main portion of an image forming apparatus 20 according to the present exemplary embodiment and using an electrophotographic system. The image forming apparatus 20 is provided with an image forming function through which various types of data are received via communication lines, not illustrated, and a color-image forming process is performed on the basis of the received data.

Note that the case will be described in which the image forming apparatus 20 according to the present exemplary embodiment performs the color-image forming process using four colors: yellow, magenta, cyan, and black. However, the colors used in the color-image forming process are not limited to the four colors. For example, the colors used in the color-image forming process may also be three colors: yellow, magenta, and cyan, and may also be multiple colors obtained by adding, to the three colors that are yellow, magenta, and cyan, one or more colors that are different from the three colors.

In addition, regarding colors, yellow, magenta, cyan, and black are denoted by respective alphabets (color codes) that are Y, M, C, and K, and the following description will be made. In addition, when structural elements of the image forming apparatus 20 need to be distinguished from each other for the colors that are yellow, magenta, cyan, and black, the description will be made in which the alphabets (color codes) that are Y, M, C, and K are added after certain numbers. In the case where the structural elements do not need to be distinguished from each other for the colors, the alphabets (color codes) that are Y, M, C, and K are omitted after the certain numbers.

The image forming apparatus 20 includes photoconductor drums 1, chargers 2, laser output units 3, developing devices 4, and first transfer devices 5. For each of the colors Y, M, C, and K, a corresponding one of the photoconductor drums 1, a corresponding one of the chargers 2, a corresponding one of the laser output units 3, a corresponding one of developing rollers 34, a corresponding one of the developing devices 4, and a corresponding one of the first transfer devices 5 are provided.

The photoconductor drums 1 include photoconductor drums 1Y, 1M, 1C, and 1K that rotate in the direction indicated by an arrow A in FIG. 1, and the chargers 2 include chargers 2Y, 2M, 2C, and 2K each of which charges the surface of a corresponding one of the photoconductor drums 1 by applying a charging bias. The laser output units 3 include laser output units 3Y, 3M, 3C, and 3K each of which exposes, to light modulated in accordance with image information for a corresponding one of the colors, the charged surface of a corresponding one of the photoconductor drums 1 and forms an electrostatic latent image on the photoconductor drum 1. The developing devices 4 are provided with the developing rollers 34, which are developer carriers for carrying developers (toner) of respective colors. The developing devices 4 include developing devices 4Y, 4M, 4C, and 4K, and form toner images on the photoconductor drums 1 by applying a developing bias to developing rollers 34Y, 34M, 34C, and 34K using a developing-bias power source, not illustrated, and by developing the electrostatic latent images on the photoconductor drums 1 using toner of the colors. The first transfer devices 5 include first transfer devices 5Y, 5M, 5C, and 5K that transfer the toner images of the colors on the photoconductor drums 1 onto an intermediate transfer belt 6.

In addition, the image forming apparatus 20 includes a paper sheet storage unit T in which paper sheets P are stored, a secondary transfer apparatus 7 that transfers, onto a paper sheet P, a toner image formed on the intermediate transfer belt 6, a fuser 9 that fixes the toner image transferred to the paper sheet P, and a belt cleaner 8 that cleans toner left on the surface of the intermediate transfer belt 6 after transfer of the toner image onto the paper sheet P. In addition, the image forming apparatus 20 includes cleaners, not illustrated, that clean the surfaces of the photoconductor drums 1, and static removers, not illustrated, that remove the residual charge of the surfaces of the photoconductor drums 1.

Furthermore, the image forming apparatus 20 includes a thermometer 58 that measures a temperature in an image forming operation environment, and a hygrometer 60 that measures humidity in the image forming operation environment.

Furthermore, the image forming apparatus 20 includes, as a controller, an image forming controller 40 that performs control regarding image forming, and a transfer controller 70 that performs control regarding transfer among the control regarding image forming.

Next, an image forming operation in the image forming apparatus 20 illustrated in FIG. 1 will be described.

First, original image information with which an image is to be formed is output to the image forming apparatus 20 from a terminal apparatus such as a personal computer, not illustrated, via communication lines, not illustrated. When the original image information is input to the image forming apparatus 20, the image forming apparatus 20 applies a charging bias to the chargers 2, and negatively charges the surface of each photoconductor drum 1.

The original image information is input to the image forming controller 40. After converting the original image information into pieces of image data for respective colors Y, M, C, and K, the image forming controller 40 outputs, to the laser output units 3 for the corresponding colors, modulation signals based on the pieces of image data for the colors. Each laser output unit 3 outputs a laser beam 11 modulated in accordance with the input modulation signal input thereto.

The modulated laser beams 11 are emitted to the surfaces of the photoconductor drums 1. The surfaces of the photoconductor drums 1 are in the state of being negatively charged by the chargers 2. When the laser beams 11 are emitted to the surfaces of the photoconductor drums 1, the electric charge of portions to which the laser beams 11 are emitted disappear, and electrostatic latent images corresponding to the image data (the colors Y, M, C, and K) included in the original image information are formed on the photoconductor drums 1.

In addition, each of the developing devices 4Y, 4M, 4C, and 4K for the respective colors includes negatively charged toner and the developing roller 34. The toner in the developing device 4Y, the toner in the developing device 4M, the toner in the developing device 4C, and the toner in the developing device 4K are colored in Y, M, C, and K, respectively. The developing roller 34 adheres the corresponding toner to the surface of the corresponding photoconductor drum 1.

When the electrostatic latent images formed on the photoconductor drums 1 reach the developing devices 4, the developing-bias power source, not illustrated, applies the developing bias to the developing rollers 34 in the developing devices 4. Thereafter, the toner of the colors carried by the peripheries of the developing rollers 34Y, 34M, 34C, and 34K is adhered to the electrostatic latent images on the respective photoconductor drums 1Y, 1M, 1C, and 1K, and toner images corresponding to the image data for the colors in the original image information are formed on the photoconductor drums 1Y, 1M, 1C, and 1K.

Furthermore, a motor, not illustrated, rotates rollers 12A, 12D, and 12E, and a backup roller 7A of the secondary transfer apparatus 7, and the intermediate transfer belt 6 is pressed against the photoconductor drums 1 by being transported into gaps formed by the first transfer devices 5 and the photoconductor drums 1. Here, when a first transfer bias is applied by the first transfer devices 5, toner images formed on the photoconductor drums 1 and based on the image data for the colors are transferred onto the intermediate transfer belt 6. Thus, by controlling rotation of the rollers 12A, 7A, 12D, and 12E such that transfer start positions of the toner images of the colors match on the intermediate transfer belt 6, the toner images of the colors overlap with each other, and a toner image corresponding to the original image information is formed on the intermediate transfer belt 6.

Extraneous matter such as residual toner adhered to the surfaces of the photoconductor drums 1 from which the toner images have been transferred onto the intermediate transfer belt 6 is removed by the cleaners, not illustrated, and residual electric charge is removed by the static removers, not illustrated.

The secondary transfer apparatus 7 includes the backup roller 7A and a secondary transfer roller 7B that extend the intermediate transfer belt 6. The secondary transfer roller 7B is in contact with the intermediate transfer belt 6, and rotates following transportation of the intermediate transfer belt 6.

In addition, a paper sheet P in the paper sheet storage unit T is transported into the gap between the backup roller 7A and the secondary transfer roller 7B (hereinafter referred to as a pair of rollers) of the secondary transfer apparatus 7 by the motor, not illustrated, rotating a paper sheet transportation roller 13.

When the paper sheet P is pressed against the intermediate transfer belt 6 by the pair of rollers in a state in which the paper sheet P faces the surface of the intermediate transfer belt 6 on which the toner image is formed, a secondary transfer bias is applied to the pair of rollers, and the toner image formed on the intermediate transfer belt 6 and corresponding to the original image information is transferred onto the paper sheet P. The toner image transferred onto the paper sheet P is heated and melted by the fuser 9, and then fixed on the paper sheet P.

In addition, extraneous matter such as residual toner adhered to the surface of the intermediate transfer belt 6 from which the toner image has been transferred onto the paper sheet P is removed by the belt cleaner 8.

As described above, the image corresponding to the original image information is formed on the paper sheet P, and the image forming operation ends.

Figure 2:
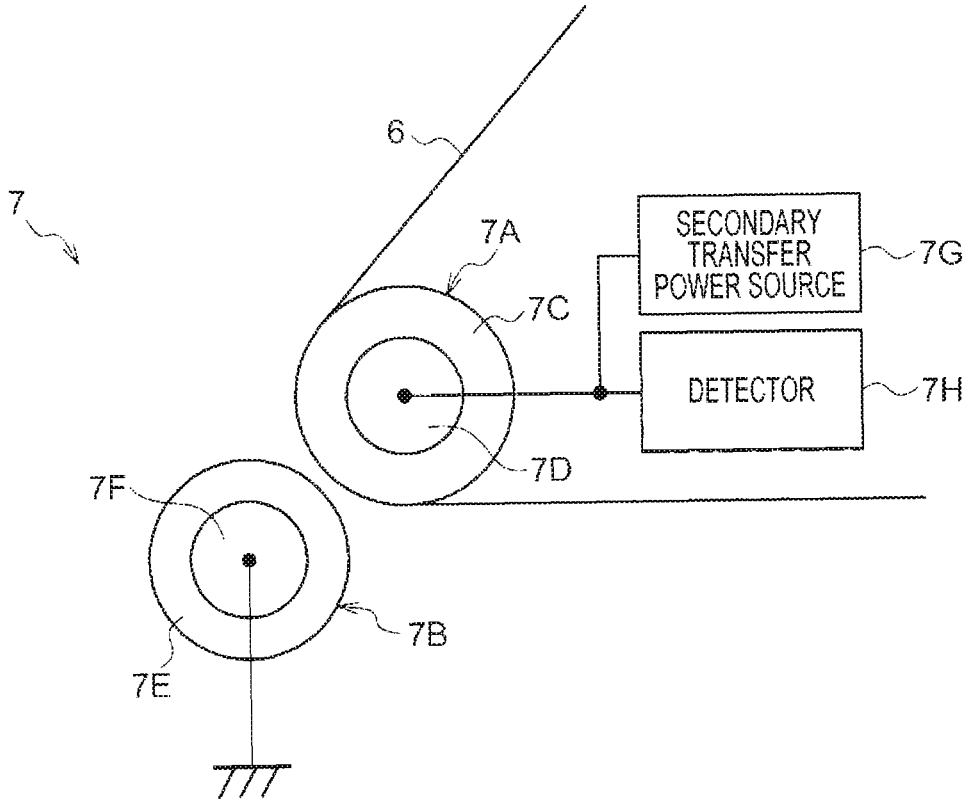
FIG. 2 is a schematic diagram used to describe the configuration of a main portion of a transfer apparatus.

FIG. 2 illustrates an example of the configuration of the secondary transfer apparatus 7 of the image forming apparatus 20 according to the present exemplary embodiment. A transfer operation performed for transfer to a paper sheet P by the secondary transfer apparatus 7 illustrated in FIG. 2 and performed in the case where an image is to be formed on the paper sheet P will be described.

The secondary transfer apparatus 7 includes the backup roller 7A, the secondary transfer roller 7B, a secondary transfer power source 7G, and a detector 7H. The backup roller 7A extends and transports the intermediate transfer belt 6 together with the rollers 12A, 12D, and 12E using the motor, not illustrated. The secondary transfer roller 7B is provided at a position at which the secondary transfer roller 7B faces the backup roller 7A with the intermediate transfer belt 6 therebetween. The secondary transfer power source 7G supplies power (a voltage and a current) to the pair of rollers. The detector 7H detects power (a voltage and a current) flowing through the pair of rollers. The detector 7H includes an ammeter that detects a current flowing through the pair of rollers when a voltage is applied to the pair of rollers by the secondary transfer power source 7G, and a voltmeter that detects a voltage across the pair of rollers when a current is applied to the pair of rollers by the secondary transfer power source 7G.

The secondary transfer power source 7G includes a constant voltage output unit 72 and a constant current output unit 74 as described in the following, and uses a direct-current power source capable of switching between constant voltage output and constant current output in accordance with a command from the transfer controller 70 (see FIG. 4). In addition, the voltage or current applied to the pair of rollers by the secondary transfer power source 7G is made adjustable by the transfer controller 70, which will be described later. A positive electrode of the secondary transfer power source 7G is connected to the ground potential (for example, 0V), which is a reference potential (not illustrated), and a negative electrode is connected to a metal shaft 7D of the backup roller 7A. The detector 7H is also connected to the metal shaft 7D of the backup roller 7A.

The backup roller 7A is, as an example, a rotatable roller having a diameter of 18 mm obtained by forming solid rubber 7C around the metal shaft 7D having a diameter of 14 mm. For the solid rubber 7C, a conductive material is used whose resistance value is adjusted to be greater than or equal to $1\times10^{6}\Omega$ but not greater than $1\times10^{7}\Omega$ by adding an ion conductive material to acrylonitrile-butadiene rubber (NBR), which has high oil resistance, high wear resistance, and high aging resistance.

Note that as an example of the solid rubber 7C, a conductive material obtained by blending NBR and epichlorohydrin rubber (ECO) may also be used. In addition, as another example, a conductive material based on polyurethane rubber obtained by adding an ion conductive material to rubber obtained by causing a polyether polyol to react with an isocyanate may also be used. Furthermore, as another example, a conductive material based on ethylene-propylene-diene rubber (EPDM) may be used.

In contrast, the secondary transfer roller 7B is, as an example, a rotatable roller having a diameter of 18 mm obtained by forming formed rubber 7E around a metal shaft 7F having a diameter of 12 mm. For the formed rubber 7E, a material is used whose resistance value is adjusted to be greater than or equal to $1\times10^{7}\Omega$ but not greater than $1\times10^{8}\Omega$ by adding an ion conductive material to urethane, which has high cushioning. Note that the metal shaft 7F is connected to the ground potential.

The transfer controller 70 (which will be described in detail later) of the secondary transfer apparatus 7 applies a negative voltage from the secondary transfer power source 7G to the pair of rollers at a timing at which a paper sheet P is transported into the gap formed by the pair of rollers.

In addition to a push pressure with which the pair of rollers pushes the paper sheet P and the intermediate transfer belt 6 while rotating, the power to strip off a negatively charged toner image from the intermediate transfer belt 6 is then generated by a negative electric field generated in the gap between the pair of rollers, and the toner image formed on the intermediate transfer belt 6 is transferred onto the paper sheet P.

Figure 3:
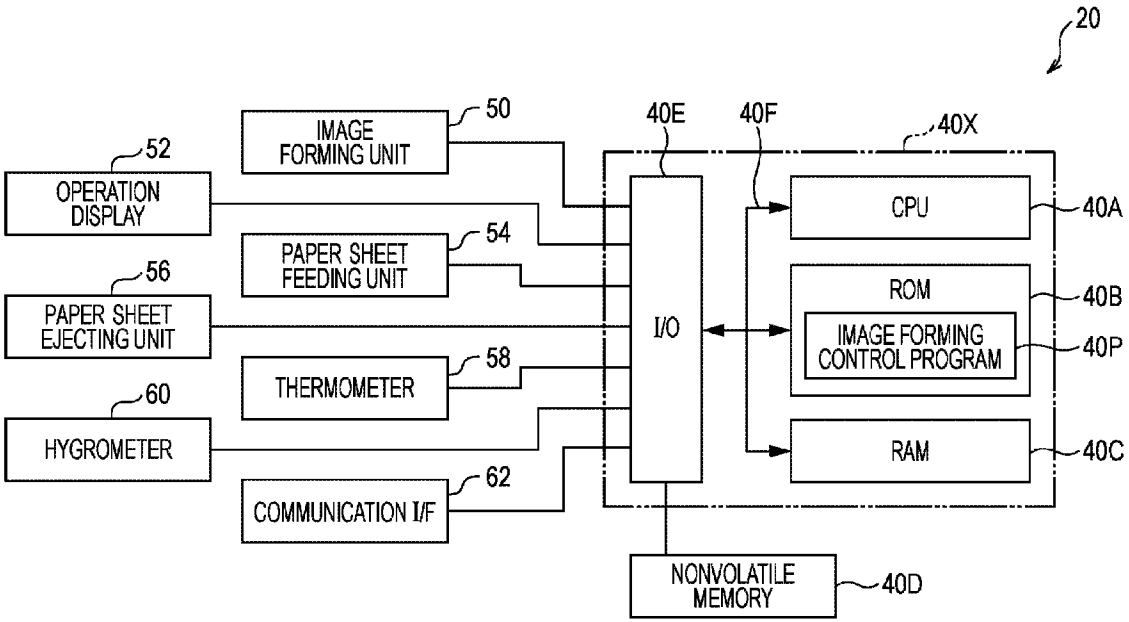
FIG. 3 is a block diagram illustrating an example of the configuration of a main portion of an electrical system of the image forming apparatus.

FIG. 3 illustrates an example of the configuration of the image forming controller 40 that performs the image forming operation in the image forming apparatus 20. FIG. 3 illustrates an example of a computer 40X, which is the image forming controller 40 when configured as a computer. The computer 40X is configured such that a central processing unit (CPU) 40A, a read-only memory (ROM) 40B, a random-access memory (RAM) 40C, a nonvolatile memory 40D, and an input-output interface (I/O) 40E are connected to each other via a bus 40F. An image forming unit 50, an operation display 52, a paper sheet feeding unit 54, a paper sheet ejecting unit 56, the thermometer 58, the hygrometer 60, and a communication I/F 62 are connected to the I/O 40E.

An image forming control program 40P that the computer 40X is caused to execute is stored in the ROM 40B. The CPU 40A reads out the image forming control program 40P from the ROM 40B, loads the image forming control program 40P into the RAM 40C, and executes a process based on the image forming control program 40P. The CPU 40A executes the process based on the image forming control program 40P, so that the computer 40X operates as the image forming controller 40. Note that the image forming control program 40P may also be provided through a recording medium such as a CD-ROM.

The image forming unit 50 includes devices necessary for the image forming apparatus 20 to execute the image forming operation. Example of the devices are the photoconductor drums 1, the chargers 2, the laser output units 3, the developing devices 4, the intermediate transfer belt 6, the secondary transfer apparatus 7, and the fuser 9.

The operation display 52 includes a touch panel display, not illustrated, hardware keys, not illustrated, and the like. A display button for realizing reception of an operation command and various types of information are displayed on the touch panel display. Examples of the hardware keys are a numeric keypad and a start button.

The paper sheet feeding unit 54 includes, for example, the paper sheet storage unit T in which paper sheets P are stored, and a feeding mechanism that feeds paper sheets P from the paper sheet storage unit T to the image forming unit 50.

The paper sheet ejecting unit 56 includes, for example, an ejection unit to which paper sheets P are ejected, and an ejection mechanism for ejecting, onto the ejection unit, a paper sheet P on which an image is formed by the image forming unit 50.

The thermometer 58 measures a temperature in an image forming operation environment of the image forming apparatus 20. Note that the thermometer 58 may measure not only the internal temperature of the image forming apparatus 20 but also, for example, a temperature in a place where the image forming apparatus 20 is installed, for example the external temperature of the image forming apparatus 20.

The hygrometer 60 measures humidity in the image forming operation environment of the image forming apparatus 20. Note that, similarly to the thermometer 58, the hygrometer 60 may measure not only the internal humidity of the image forming apparatus 20 but also, for example, humidity in the place where the image forming apparatus 20 is installed, for example the external humidity of the image forming apparatus 20.

The communication I/F 62 is an interface for mutually performing data communication with a terminal apparatus such as a personal computer, not illustrated.

Figure 4:
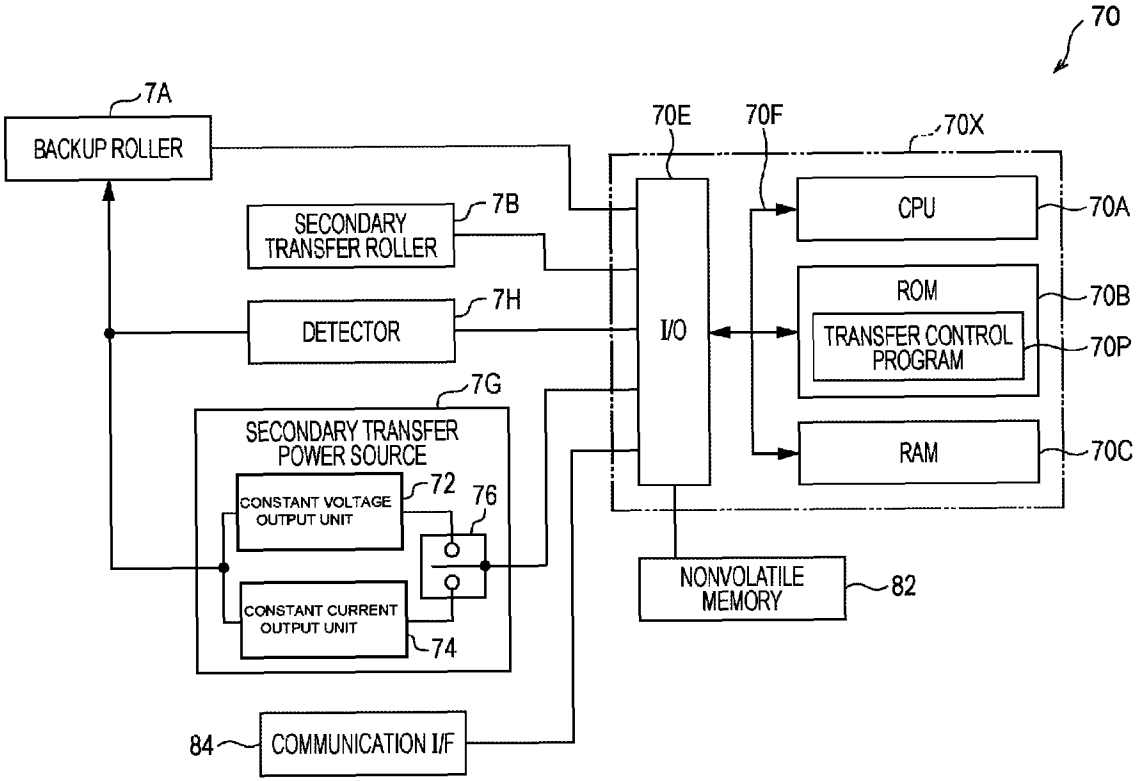
FIG. 4 is a block diagram illustrating an example of the configuration of a main portion of an electrical system of the transfer apparatus.

FIG. 4 illustrates an example of the configuration of the transfer controller 70 of the secondary transfer apparatus 7 according to the present exemplary embodiment. FIG. 4 illustrates an example of a computer 70X, which is the transfer controller 70 when configured as a computer. The computer 70X is configured such that a CPU 70A, a ROM 70B, a RAM 70C, and an I/O 70E are connected to each other via a bus 70F. The backup roller 7A, the secondary transfer roller 7B, the secondary transfer power source 7G, the detector 7H, a nonvolatile memory 82, and a communication I/F 84 are connected to the I/O 70E. Note that the CPU 70A may be connected to the image forming controller 40 (the I/O 40E of the computer 40X) of the image forming apparatus 20 via the communication I/F 84.

A transfer control program 70P that the computer 70X is caused to execute is stored in the ROM 70B. The CPU 70A reads out the transfer control program 70P from the ROM 70B, loads the transfer control program 70P into the RAM 70C, and executes a process based on the transfer control program 70P. The CPU 70A executes the process based on the transfer control program 70P, so that the computer 70X operates as the transfer controller 70. Note that the form of supplying the transfer control program 70P in a state in which the transfer control program 70P is stored on a computer readable recording medium such as a CD-ROM, the form of distributing the transfer control program 70P via a wired or wireless communication unit, and the like may also be applied.

The secondary transfer power source 7G includes the constant voltage output unit 72 that outputs a constant voltage and the constant current output unit 74 that outputs a constant current. In addition, the secondary transfer power source 7G includes a switching unit 76 to which the transfer controller 70 is connected. The switching unit 76 performs switching between power output from the constant voltage output unit 72 and power output from the constant current output unit 74 in accordance with a command from the transfer controller 70. In addition, the value of output power (a voltage or a current) from each of the constant voltage output unit 72 and the constant current output unit 74 is set by the transfer controller 70, and the power output from the secondary transfer power source 7G is adjustable.

The detector 7H measures power (a current or a voltage) at the pair of rollers when a predetermined power (a voltage or a current) is applied to the pair of rollers. That is, the detector 7H includes the ammeter that detects a current flowing through the pair of rollers when a voltage is applied to the pair of rollers by the secondary transfer power source 7G, and the voltmeter that detects a voltage across the pair of rollers when a current is applied to the pair of rollers by the secondary transfer power source 7G. The detector 7H detects a current flowing through the pair of rollers in the case where a predetermined voltage is supplied from the secondary transfer power source 7G. The detector 7H detects a voltage across the pair of rollers in the case where a predetermined current is supplied from the secondary transfer power source 7G.

The nonvolatile memory 82 stores values of voltages and currents used in the secondary transfer apparatus 7 (details will be described later). Note that the nonvolatile memory 82 is not necessary for the secondary transfer apparatus 7, and for example the nonvolatile memory 40D included in the computer 40X of the image forming apparatus 20 may be substituted.

In addition, as information indicating the values of the voltages and currents used in the secondary transfer apparatus 7 and stored in the nonvolatile memory 82, information indicating values of voltages and currents predetermined in accordance with attribute information regarding paper sheets P such as type information (normal paper, embossed paper, coated paper, or the like) regarding the paper sheets P to be used in image forming and size information (A3, A4, or the like) regarding the paper sheets P may be stored.

The voltage of the secondary transfer power source 7G that the secondary transfer apparatus 7 applies to the pair of rollers at the time of transfer (hereinafter referred to as transfer voltage) is set on the basis of the resistance value of the pair of rollers (hereinafter referred to as a system resistance value).

However, the system resistance value changes in accordance with the characteristics of the solid rubber 7C and those of the formed rubber 7E. For example, due to uneven addition of the ion conductive material or addition of foreign matter to the solid rubber 7C and the formed rubber 7E, the system resistance value changes every time a toner image is transferred onto a paper sheet P.

In an example of constant voltage control in the case where the system resistance value is calculated, a predetermined voltage (hereinafter referred to as transfer-voltage setting voltage), which is a constant voltage, is applied from the secondary transfer power source 7G in a period in which a toner image formed on the intermediate transfer belt 6 is not transferred onto a paper sheet P (hereinafter referred to as non-transfer period). The current flowing through the pair of rollers (hereinafter referred to as detection current) is then detected by the detector 7H, the system resistance value is calculated, before transfer, from the relationship between the transfer-voltage setting voltage and the detection current, and the transfer voltage is set.

In a transfer operation for toner-image transfer onto paper sheets P, toner images formed on the intermediate transfer belt 6 for multiple pages may be consecutively transferred onto multiple paper sheets P. In this case, the distance between a paper sheet P and the next paper sheet P (hereinafter referred to as gap between paper sheets) may be short (for example, less than the length of one revolution of the pair of rollers) depending on an image forming speed (hereinafter referred to as process speed) determined on the basis of the speed of transporting a paper sheet P, the speed of transporting the intermediate transfer belt 6, and the like.

When the system resistance value is calculated in this manner, the transfer-voltage setting voltage is applied and the detection current may be detected multiple times while the pair of rollers is caused to be rotating, for example, for one or more revolutions. The reason why the pair of rollers is caused to rotate for one or more revolutions when the transfer-voltage setting voltage is applied is to consider that the resistance values of the pair of rollers differ on a periphery-portion basis. That is, while the pair of rollers is caused to be rotating for one or more revolutions, the detection current is detected at multiple positions on the peripheries of the pair of rollers, the average of the values of the detected detection currents is used to calculate the system resistance value. As a result, the system resistance value of the secondary transfer apparatus 7 that does not depend only on the resistance value of a specific portion on the peripheries of the pair of rollers may be calculated.

However, the system resistance value changes in accordance with an apparatus environment. For example, in the solid rubber 7C and the formed rubber 7E each of which uses a certain conductive material to which a certain ion conductive material is added, the system resistance value changes depending on an environment state based on, for example, a temperature and humidity at the time of transfer.

Figure 5:
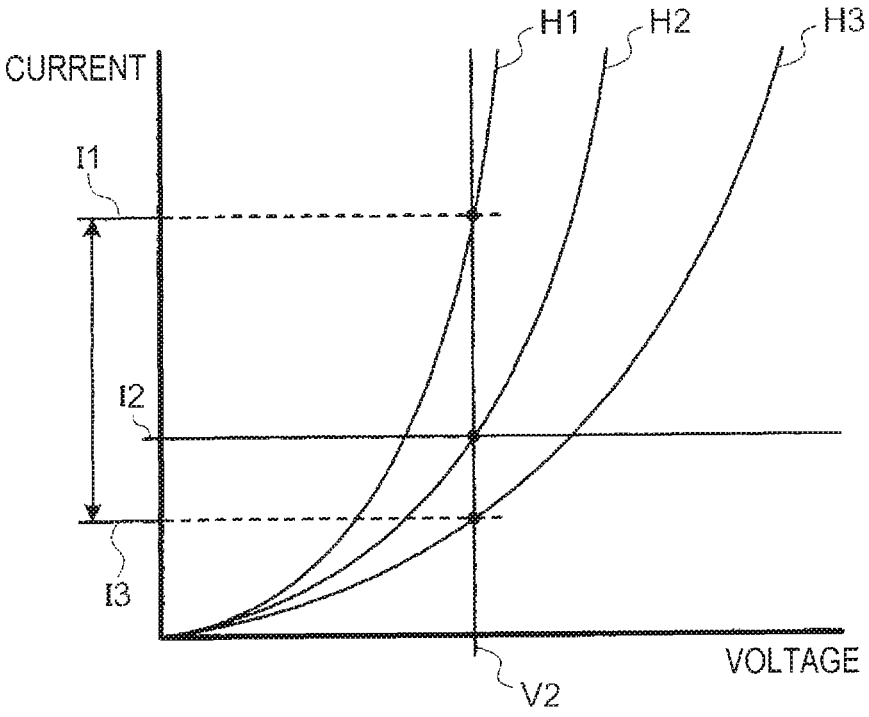
FIG. 5 is a conceptual image illustrating an example of voltage-current characteristics of a conductive material.

FIG. 5 illustrates voltage-current characteristics regarding, for example, a certain conductive material to which a certain ion conductive material is added (for example, the solid rubber 7C). Curves H1, H2, and H3 illustrate voltage-current characteristics in respective humidity environment states in which humidity differs from each other. The conductive material has a voltage dependence, and also a humidity-environment-state dependence. As illustrated in FIG. 5, the current value appropriate for a voltage value V2 is a value I2 in the voltage-current characteristics obtained in the humidity environment state indicated by the curve H2. Thus, a voltage having a voltage value of V2 is applied as a transfer-voltage setting voltage, a detection current is detected, and a system resistance value is calculated. However, in different humidity environment states, that is, in the voltage-current characteristics indicated by the curve H1, the voltage value V2 corresponds to a current value I1, and in the voltage-current characteristics indicated by the curve H3, the voltage value V2 corresponds to a current value I3. Variations arise in current value, and image quality may be deteriorated at the time of transfer.

In order to reduce such variations in current, performing of constant current control that maintains the current flowing through the pair of rollers at a constant level is considered; however, in the case where constant current control is performed, the responsiveness under constant current control is slower than that under constant voltage control, and thus the productivity is reduced.

Thus, in the present exemplary embodiment, in the case where an environment state based on, for example, a temperature and humidity exceeds a predetermined change range, the transfer-voltage setting voltage is corrected to a voltage obtained through constant current output using a predetermined current.

Next, the transfer operation performed for a paper sheet P by the secondary transfer apparatus 7 of the image forming apparatus 20 according to the present exemplary embodiment when an image is formed on a paper sheet P will be described in detail.

Note that, for a transfer-voltage setting voltage Vo used in the following description, a current flowing through the pair of rollers in a standard environment state is obtained in advance through an experiment or the like, and is prestored in the nonvolatile memory 82. For the transfer-voltage setting voltage Vo stored in the nonvolatile memory 82, information corresponding to attribute information such as the paper sheet type of a paper sheet P onto which a toner image is to be transferred, size information regarding the paper sheet P, and transfer-surface information (information indicating whether a surface onto which transfer is to be performed (hereinafter simply referred to as transfer surface) is the front or rear surface of the paper sheet P) is stored. In addition, for a voltage-correction current Io, a current flowing through the pair of rollers in the standard environment state is obtained in advance through an experiment or the like, and is prestored so as to be associated with the attribute information in the nonvolatile memory 82.

Figure 6:
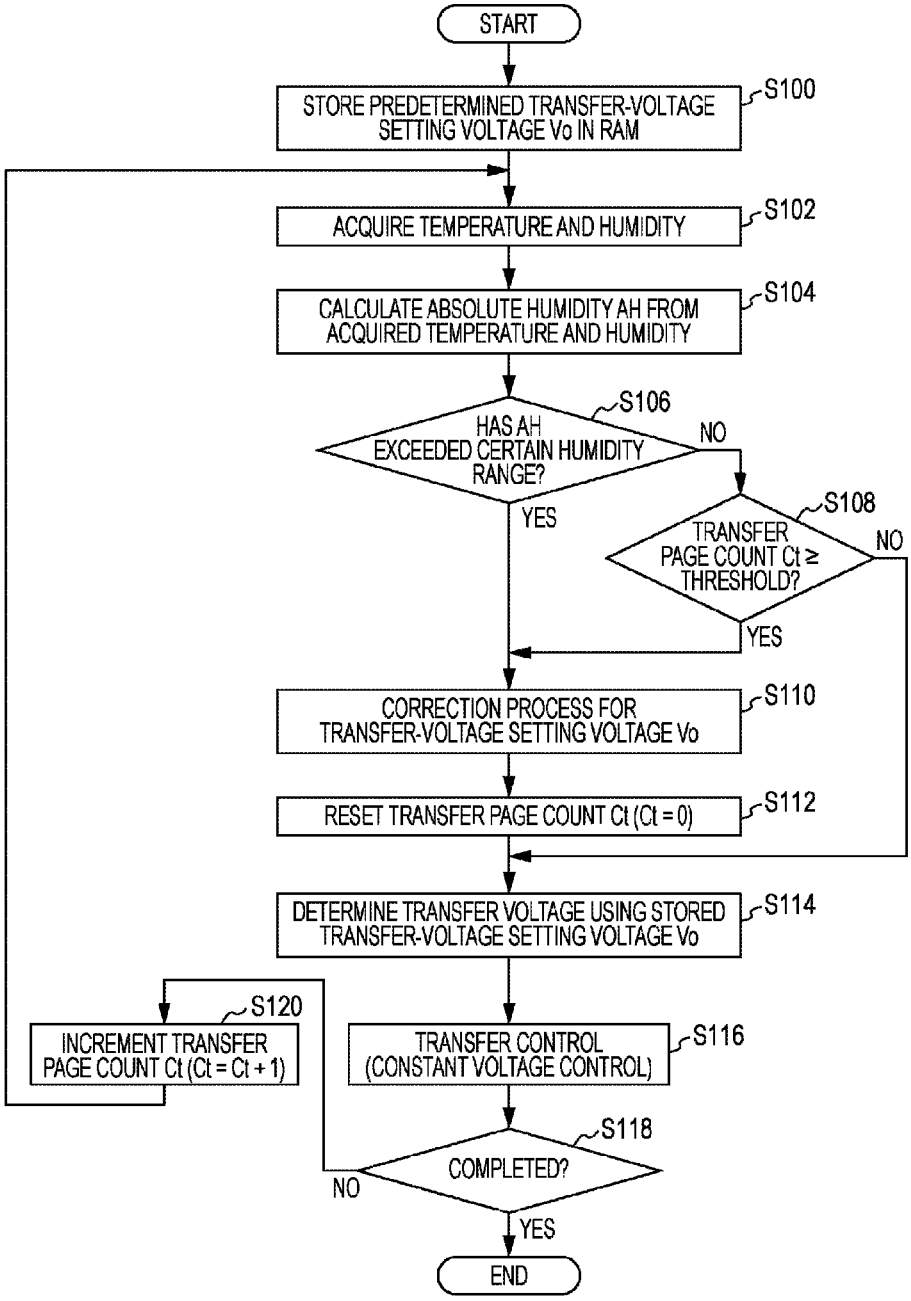
FIG. 6 is flowchart illustrating an example of a process executed by a computer of the transfer apparatus.

FIG. 6 illustrates a flowchart of the transfer control program 70P executed by the CPU 70A of the computer 70X, the CPU 70A operating as the transfer controller 70 of the secondary transfer apparatus 7 at the time of image forming.

The transfer control program 70P is executed by the CPU 70A when a transfer start command is received from the CPU 40A of the image forming apparatus 20 via the I/O 40E.

First, the process proceeds to step S100 in accordance with the transfer start command from the CPU 40A of the image forming apparatus 20, and the transfer-voltage setting voltage Vo stored in the nonvolatile memory 82 is stored in a predetermined area of the RAM 70C. The transfer start command from the CPU 40A includes attribute information regarding paper sheets P onto which toner images are to be transferred. Thus, in step S100, the transfer-voltage setting voltage Vo corresponding to the attribute information regarding the paper sheets P is stored in a predetermined area of the RAM 70C. Note that the transfer start command includes information indicating the process speed and information indicating a transfer page count. In addition, in step S100, a counter that takes a transfer page count Ct is reset (Ct=0).

Next, in step S102, information indicating a temperature and humidity is acquired as an image forming operation environment of the image forming apparatus 20. The CPU 70A requests, at this point in time, information indicating the temperature measured by the thermometer 58 and information indicating the humidity measured by the hygrometer 60 from the image forming controller 40, and acquires the information indicating the temperature and the information indicating the humidity output from the image forming controller 40. Note that information indicating the transfer start command when the transfer start command is issued may also include information indicating a temperature and humidity at the time when the transfer start command is issued.

Next, in step S104, absolute humidity AH is calculated using the following Expression (1) using the information indicating the temperature and humidity acquired in step S102.

$$AH=(5.375-0.077-TP+0.0027-TP^2)-RH/100 \quad (1)$$

where TP represents temperature and RH represents humidity. Note that the absolute humidity AH does not have to be calculated from Expression (1).

Next, in step S106, it is determined whether the absolute humidity AH has exceeded a certain humidity range. The certain humidity range indicates an environment change (humidity change) range in which image deterioration caused at the time of transfer is allowable, and may be obtained in advance through an experiment or the like. In the case where YES is obtained in step S106, the process proceeds to step S110. In the case where NO is obtained in step S106, the process proceeds to step S108.

In step S108, it is determined whether the transfer page count Ct is greater than or equal to a threshold. The threshold indicates a consecutive transfer page count at which it is expected that image deterioration occurs in the case where toner images for multiple pages have been consecutively transferred onto multiple paper sheets P, and is for example a value prestored in a predetermined area of the nonvolatile memory 82 such that setting of the threshold is changeable. As an example, the threshold is set to 100 (pages) in the present exemplary embodiment. In the case where YES is obtained in step S108, the process proceeds to step S110. In the case where NO is obtained in step S108, the process proceeds to step S114.

That is, in the case where the environment state based on the temperature and humidity and the transfer page count Ct fall within allowable ranges when the transfer start command is received, transfer control is performed under constant voltage control in and after step S114.

Specifically, in step S114, a transfer voltage is determined using the transfer-voltage setting voltage Vo stored in the RAM 70C. Next, in step S116, transfer control is performed in which the transfer voltage is maintained.

Figure 7:
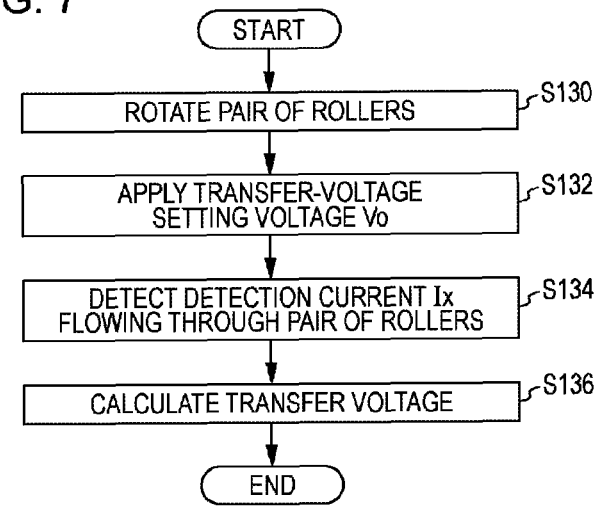
FIG. 7 is a flowchart illustrating an example of a transfer voltage determination process.

FIG. 7 illustrates an example of a transfer voltage determination process as a detailed process of step S114 of the transfer control program 70P.

First, in step S130, driving of the pair of rollers (the backup roller 7A and the secondary transfer roller 7B) is started by the motor, not illustrated. Here, the motor, not illustrated, is driven in accordance with the process speed included in the transfer start command.

In step S132, the secondary transfer power source 7G is controlled so as to apply the transfer-voltage setting voltage Vo to the pair of rollers. For the transfer-voltage setting voltage Vo, information indicating a voltage value stored in the RAM 70C is used. Specifically, the CPU 70A commands the switching unit 76 to cause the constant voltage output unit 72 to output the transfer-voltage setting voltage Vo as a constant voltage.

Next, in step S134, the detector 7H is controlled such that a detection current Ix flowing through the pair of rollers is detected using the transfer-voltage setting voltage Vo applied from the secondary transfer power source 7G to the pair of rollers in step S132, and also the value of the detected detection current Ix is acquired from the detector 7H and stored in, for example, a predetermined area of the RAM 70C.

In this case, the detector 7H is controlled so as to detect, over a period necessary for the pair of rollers to make one revolution, the detection current Ix flowing through the pair of rollers. Note that, as an example, the detector 7H according to the present exemplary embodiment detects thirty points of the detection current Ix during the period necessary for the pair of rollers to make one revolution.

In step S136, in the case where a toner image is transferred onto a paper sheet P that is the first page, a transfer voltage to be applied from the secondary transfer power source 7G to the pair of rollers is set on the basis of the transfer-voltage setting voltage Vo applied to the pair of rollers in step S132 and the detection current Ix detected in step S134.

Specifically, first, an average detection current Im of the detection current Ix is calculated from the thirty points of the detection current Ix acquired in step S134, and a system resistance value Rr is obtained using Expression (2) using the transfer-voltage setting voltage Vo and the average detection current Im.

$$Rr=Vo/Im \tag{2}$$

Here, Vo represents the transfer-voltage setting voltage. In the present exemplary embodiment, the average of the thirty points of the detection current Ix acquired in step S134 is used as the average detection current Im; however, a value representing multiple detection current values such as a median value or a mode may also be used.

Next, a transfer voltage is calculated by substituting the system resistance value Rr into Expression (3).

$$V\text{out}=\alpha Rr+\beta \tag{3}$$

Note that Vout represents the transfer voltage. In addition, $\alpha$ and $\beta$ are constants each of which is uniquely determined from a combination of pieces of extra information regarding transfer such as a process speed, a paper sheet type, size information, paper-sheet surface information, and environment information, are values obtained in advance through an experiment performed actually using the secondary transfer apparatus 7 or a computer simulation based on the design specification of the secondary transfer apparatus 7, and are for example values determined in accordance with a table prestored in a predetermined area of the nonvolatile memory 82.

Note that, in addition to the above-described method, $\alpha$ and $\beta$ may also be calculated by for example substituting, into a predetermined function prestored in a predetermined area of the nonvolatile memory 82, a number into which extra information regarding transfer such as a process speed, a paper sheet type, size information, paper-sheet surface information, and environment information is converted.

When the transfer voltage Vout is determined as described above, in step S116 illustrated in FIG. 6, transfer control is performed in which the transfer voltage Vout is maintained and a toner image is transferred onto the paper sheet P that is the first page, and the process proceeds to step S118.

In step S118, it is determined whether the transfer process is completed by determining whether a page count that is the number of pages for which toner images are transferred onto paper sheets P has reached a transfer page count. In the case where YES is obtained in step S118, processing of the transfer control program 70P ends. In the case where NO is obtained in step S118, the process proceeds to step S120. After the counter that takes the transfer page count Ct is incremented (Ct=Ct+1), the process returns to step S102, and processing is repeated until transfer for the last page is performed.

In the case where the environment state based on, for example, the temperature and humidity exceeds the predetermined change range, image deterioration may occur at the time of transfer. Thus, in the present exemplary embodiment, the transfer-voltage setting voltage is corrected to a voltage obtained through constant current output using a predetermined current. Specifically, in the case where YES is obtained in step S106 illustrated in FIG. 6 (the absolute humidity AH>the certain humidity range), a correction process for the transfer-voltage setting voltage Vo is performed in step S110, and the transfer page count Ct is reset (Ct=0) in step S112. Thereafter, the process proceeds to step S114.

Figure 8:
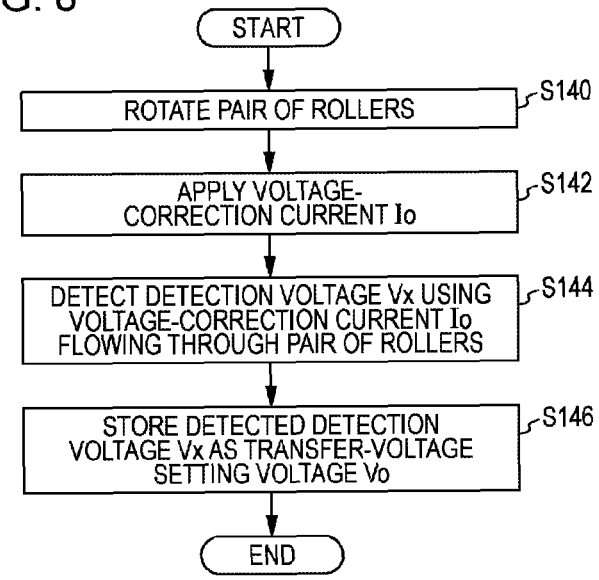
FIG. 8 is a flowchart illustrating an example of a correction process for a transfer-voltage setting voltage.

FIG. 8 illustrates an example of the correction process for the transfer-voltage setting voltage Vo as a detailed process of step S110 of the transfer control program 70P.

First, in step S140, driving of the pair of rollers is started by the motor, not illustrated, in accordance with the process speed included in the transfer start command.

In step S142, the secondary transfer power source 7G is controlled so as to apply the voltage-correction current Io to the pair of rollers. For the voltage-correction current Io, information indicating a current value stored in the nonvolatile memory 82 is used. Specifically, the CPU 70A commands the switching unit 76 to cause the constant current output unit 74 to output the voltage-correction current Io as a constant current output.

Next, in step S144, the detector 7H is controlled such that a detection voltage Vx across the pair of rollers is detected using the voltage-correction current Io applied from the secondary transfer power source 7G to the pair of rollers in step S142, and also the value of the detected detection voltage Vx is acquired from the detector 7H.

In this case, the detector 7H is controlled so as to detect, over a period necessary for the pair of rollers to make one revolution, the detection voltage Vx across the pair of rollers. Note that, as an example, the detector 7H according to the present exemplary embodiment detects thirty points of the detection voltage Vx during the period necessary for the pair of rollers to make one revolution.

In step S146, the detection voltage Vx detected in step S144 is set to the transfer-voltage setting voltage Vo. Specifically, first, an average detection voltage Vm of the thirty points of the detection voltage Vx detected in step S144 is calculated, and correction is performed in which the transfer-voltage setting voltage Vo that has already been stored is updated to the calculated average detection voltage Vm. That is, the average detection voltage Vm is stored as the transfer-voltage setting voltage Vo in the RAM 70C. As a result, the transfer-voltage setting voltage Vo is corrected to a voltage corresponding to a current flowing through the pair of rollers in an environment state based on, for example, high humidity.

Note that, in the present exemplary embodiment, the average detection voltage Vm calculated using the average of the detection voltages detected in a range corresponding to one revolution of the pair of rollers detection voltage (for example, the thirty points of the detection voltage Vx) is used; however, the average detection voltage Vm does not have to be used, and also a calculation method is not limited to this method. For example, the average detection voltage Vm may also be calculated using detection voltages obtained by excluding, from the detection voltages detected in the range corresponding to one revolution of the pair of rollers, detection voltages whose voltage values are included in a predetermined range from at least one of an upper-limit side and a lower-limit side of the detected detection voltages. In addition, a representative detection voltage may also be used.

Figure 9:
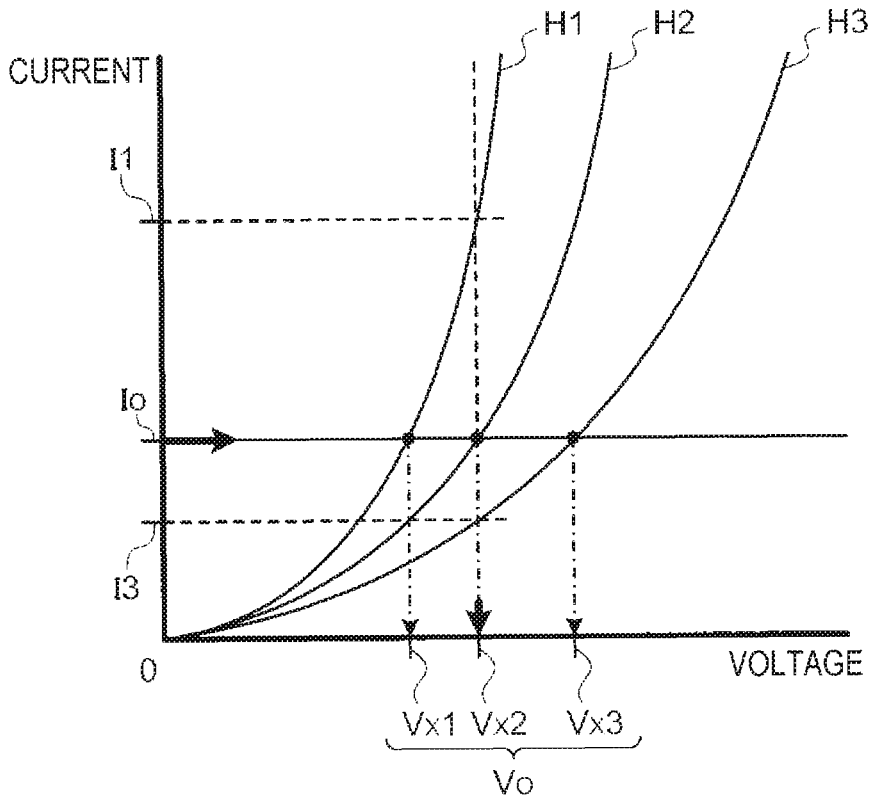
FIG. 9 is a diagram for describing the process of correction of the transfer-voltage setting voltage.

FIG. 9 illustrates the process of calculation of the detection voltage Vx to which the transfer-voltage setting voltage Vo is corrected in accordance with an environment state.

Curves H1, H2, and H3 illustrate voltage-current characteristics in respective humidity environment states in which humidity differs from each other. For example, in the voltage-current characteristics in the certain humidity environment state indicated by the curve H2, a detection voltage Vx2 is detected using the voltage-correction current Io. However, in the case where constant voltage control is performed using a transfer voltage calculated using the detection voltage Vx2, the current in the humidity environment state indicated by the curve H1 is a current I1, which is excessive as a supply current, and it is expected that the density of a toner image is increased when transfer is performed. In contrast, the current in the humidity environment state indicated by the curve H3 is a current I3, which is insufficient as a supply current, and it is expected that the density of a toner image is reduced when transfer is performed.

Thus, in the present exemplary embodiment, the secondary transfer power source 7G is controlled so as to apply the voltage-correction current Io to the pair of rollers, and the detection voltage Vx corresponding to an environment state is detected. Specifically, a detection voltage Vx1 is detected in the humidity environment state indicated by the curve H1, a detection voltage Vx2 is detected in the humidity environment state indicated by the curve H2, and a detection voltage Vx3 is detected in the humidity environment state indicated by the curve H3. The transfer-voltage setting voltage Vo is then corrected to the detection voltage Vx corresponding to the voltage-correction current Io flowing through the pair of rollers in an environment state based on, for example, humidity.

Thus, the voltage-correction current Io is applied to the pair of rollers under constant voltage control using the detection voltage Vx1 in the humidity environment state indicated by the curve H1. In addition, the voltage-correction current Io is applied to the pair of rollers under constant voltage control using the detection voltage Vx2 in the humidity environment state indicated by the curve H2, and under constant voltage control using the detection voltage Vx3 in the humidity environment state indicated by the curve H3.

Transfer control is performed under constant voltage control using the transfer-voltage setting voltage Vo determined in accordance with the environment state in this manner. That is, a transfer voltage is determined using the transfer-voltage setting voltage Vo, and transfer control is performed in which the transfer voltage is maintained.

According to the present exemplary embodiment as described above, in a non-transfer period in the case where a toner image formed on the intermediate transfer belt 6 is to be transferred onto a paper sheet P, the transfer-voltage setting voltage Vo is determined such that the voltage-correction current Io is applied to the pair of rollers in accordance with an environment state based on humidity as an image forming operation environment of the image forming apparatus 20, and the system resistance value Rr is calculated. A transfer voltage is determined using the system resistance value Rr, and transfer control is performed under constant voltage control.

In addition, according to the present exemplary embodiment, in the case where multiple toner images are consecutively transferred onto predetermined multiple paper sheets P (in the case where the transfer page count Ct exceeds a threshold), correction of the transfer-voltage setting voltage Vo to a voltage corresponding to an environment state is forced. That is, when toner images for multiple pages are consecutively transferred onto multiple paper sheets P, it is expected that the system resistance value Rr of the pair of rollers before consecutive transfer changes and image deterioration occurs.

Second Exemplary Embodiment

Next, a second exemplary embodiment will be described. Note that the configuration of the second exemplary embodiment is substantially the same as that of the first exemplary embodiment, and thus portions the same as those in the first exemplary embodiment are denoted by the same reference numerals and description thereof will be omitted.

The transfer-voltage setting voltage Vo is corrected in the first exemplary embodiment since it is expected that image deterioration occurs in the case where toner images for multiple pages (as an example, 100 pages) have been consecutively transferred onto multiple paper sheets P. In the second exemplary embodiment, whether the transfer-voltage setting voltage Vo is to be corrected is determined on a job basis. Specifically, a transfer page count is grasped on a job basis, and in the case where the sum of the number of pages for which transfer has been consecutively performed exceeds a threshold when transfer is performed for the job for which a transfer process is to be performed from now, the transfer-voltage setting voltage Vo is corrected before the transfer process is performed for the job.

Next, an operation of a computer serving as the transfer controller 70 according to the second exemplary embodiment will be described.

Figure 10:
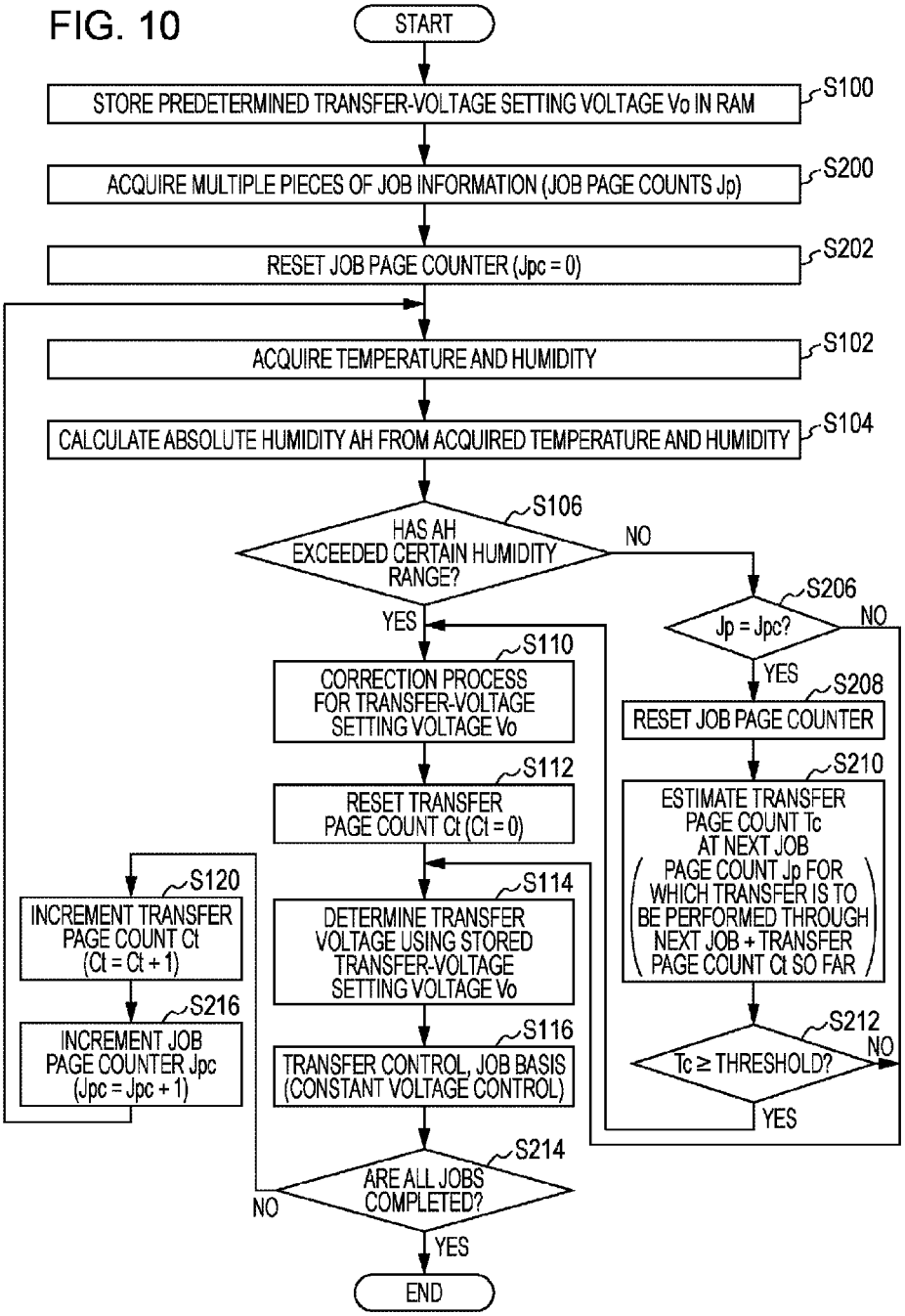
FIG. 10 is a flowchart illustrating an example of a process executed by a computer of a transfer apparatus according to a second exemplary embodiment.

FIG. 10 illustrates a flowchart of the transfer control program 70P executed by the CPU 70A of the computer 70X, the CPU 70A operating as the transfer controller 70 of the secondary transfer apparatus 7 at the time of image forming in the image forming apparatus 20 according to the present exemplary embodiment. The process illustrated in FIG. 10 is executed instead of the process routine illustrated in FIG. 6 in the first exemplary embodiment.

The transfer control program 70P is executed by the CPU 70A when a transfer start command is received from the CPU 40A of the image forming apparatus 20 via the I/O 40E.

First, the transfer-voltage setting voltage Vo is stored in a predetermined area of the RAM 70C (step S100). Next, in step S200, the CPU 70A acquires pieces of job information indicating multiple jobs. Thereafter, in step S202, a job page counter Jpc indicating a page count for which transfer has been performed through a job is reset (Jpc=0). Note that each job information includes information indicating a page count Jp for which transfer is to be performed through the job.

Next, as an image forming operation environment, information indicating a temperature and humidity is acquired (step S102). Thereafter, absolute humidity AH is calculated using the information indicating the acquired temperature and humidity and Expression (1) described above (step S104).

Next, in the case where the absolute humidity AH exceeds a certain humidity range (YES in step S106), similarly to as in the first exemplary embodiment, a correction process for the transfer-voltage setting voltage Vo is performed, and then the transfer page count Ct is reset (Ct=0) (steps S110 and S112). Transfer control is then performed under constant voltage control (steps S114 and S116).

In contrast, in the case where the absolute humidity AH falls within the certain humidity range (NO in step S106), the process proceeds to step S206, and it is determined whether the page count indicated by the job page counter Jpc has reached the page count Jp for which transfer is to be performed through the current job (Jp=Jpc). In the case where the page count indicated by the job page counter Jpc has not yet reached the page count Jp for which transfer is to be performed through the current job (NO in step S206), a transfer voltage is determined as is, that is, using the transfer-voltage setting voltage Vo stored in the RAM 70C, and transfer control is performed (steps S114 and S116). In the case where the page count indicated by the job page counter Jpc has reached the page count Jp for which transfer is to be performed through the current job (YES in step S206), the job page counter Jpc is reset (Jpc=0) in step S208. Next, in step S210, a transfer page count Tc at the next job is estimated.

In step S210, the total transfer page count at the next job is estimated by adding the page count Jp for which transfer is to be performed through the next job, for which transfer is to be performed from now, and the transfer page count Ct taken so far (Tc=Jp+Ct). Next, in step S212, it is determined whether the transfer page count Tc estimated in step S210 is greater than or equal to a threshold. Similarly to as in the above-described exemplary embodiment, the threshold indicates a consecutive transfer page count (for example, 100 (pages)) at which it is expected that image deterioration occurs in the case where toner images for multiple pages have been consecutively transferred onto multiple paper sheets P. In the case where YES is obtained in step S212, the process proceeds to step S110. In the case where NO is obtained in step S212, the process proceeds to step S114.

That is, in the case where the environment state based on the temperature and humidity and the transfer page count fall within allowable ranges when the transfer start command is received, transfer control is performed under constant voltage control in and after step S114. In addition, in the case where a page count for which transfer is to be performed through the job for which transfer is to be performed from now, that is, the next job exceeds an allowable range (threshold), the correction process for the transfer-voltage setting voltage Vo is performed.

In the case where a page count for which transfer is to be performed through one job exceeds the threshold, the one job is divided into multiple jobs each of which has a page count that does not exceed the threshold. For example, in the case where the page count for which transfer is to be performed through one job is 150 pages, division is performed as in 75 pages+75 pages, 100 pages+50 pages, or the like. Preset values or values set by a user may also be used as the number of jobs into which one job is divided and the pages of the jobs into which the one job is divided.

After transfer control is performed under constant voltage control (steps S114 and S116), the process proceeds to step S214.

In step S214, whether the process ends is determined by determining whether the number of jobs for which toner images have been transferred has reached the number of jobs acquired in step 200. In the case where YES is obtained in step S214, processing of the transfer control program 70P ends. In the case where NO is obtained in S214, the counter that takes the transfer page count Ct is incremented (step S120), and then the process proceeds to step S216. In step S216, the job page counter Jpc is incremented (Jpc=Jpc+1). Thereafter, the process returns to step S102, and processing is repeated until transfer for the last job ends.

As described above, according to the present exemplary embodiment, it is estimated whether the transfer page count exceeds the threshold on a job basis in the case where multiple pages are consecutively transferred. In the case where the transfer page count exceeds the threshold at the next job, the correction process for the transfer-voltage setting voltage Vo is performed.

The present invention has been described above using the exemplary embodiments; however, the technical scope of the present invention is not limited to the scope described in the exemplary embodiments above. Various modifications or improvements may be added to the exemplary embodiments described above without departing from the gist of the invention, and exemplary embodiments obtained by adding the variations or modifications to the exemplary embodiment described above also fall within the technical scope of the invention.

In addition, the cases where the transfer control process is realized with a software configuration based on processing using the flowcharts illustrated in FIGS. 6 and 10 is described in the exemplary embodiments described above; however, the way in which the transfer control process is realized is not limited to this. For example, the transfer control process may also be realized with a hardware configuration.

As an example of an exemplary embodiment in this case, for example, there may be a case where a functional device that executes the same process as the transfer controller 70 of the secondary transfer apparatus 7 is generated and used. In this case, the process speed is expected to increase more than those in the exemplary embodiments described above.

Note that the image forming apparatus 20 according to the present exemplary embodiment forms color images; however, as a matter of course the image forming apparatus 20 may also form monochrome images. In addition, the secondary transfer roller 7B of the secondary transfer apparatus 7 according to the present exemplary embodiment is not limited to the form including a single roller. For example, multiple rollers and belts including the secondary transfer roller 7B, another roller that is not illustrated, and a belt extending around the secondary transfer roller 7B and the other roller that is not illustrated may also be included in the secondary transfer apparatus 7.

In addition, the secondary transfer apparatus 7 according to the present exemplary embodiment applies a negative transfer voltage from the secondary transfer power source 7G to the pair of rollers. This is performed to strip off a negatively charged toner image from the intermediate transfer belt 6, and thus when a toner image is positively charged, a positive transfer voltage is applied to the pair of rollers.

In addition, the transfer control process according to the present exemplary embodiment is described using as an example the secondary transfer apparatus 7 of the image forming apparatus 20; however, the transfer control process according to the present exemplary embodiment may also be applied to the first transfer devices 5.

Furthermore, the transfer control process according to the present exemplary embodiment may be performed not only by the secondary transfer apparatus 7 of the image forming apparatus 20 but also by, for example, a transfer apparatus that transfers a charged toner image onto an object onto which transfer is to be performed, the object being, for example, paper, a plastic sheet, typified by an overhead projector (OHP) sheet, metal, or rubber.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer apparatus comprising:

a transfer unit configured to transfer a toner image onto an object onto which transfer is to be performed;

a first detector configured to detect humidity;

a supplying unit configured to supply a transfer voltage to the transfer unit, that is configured to supply a setting voltage to the transfer unit in a case where the humidity detected by the first detector is less than or equal to a threshold in a non-transfer period before the toner image is transferred onto the object onto which transfer is to be performed, and that is configured to supply a setting current in a case where the humidity detected by the first detector exceeds the threshold in the non-transfer period;

a second detector configured to detect a current flowing through the transfer unit in response to supply of the setting voltage and that detects a voltage generated across the transfer unit in response to supply of the setting current; and a controller configured to control the supplying unit such that, when transfer is performed in a case where the humidity detected by the first detector is less than or equal to the threshold, a transfer voltage derived using the setting voltage and the current detected by the second detector is supplied to the transfer unit, and when transfer is performed in a case where the humidity detected by the first detector exceeds the threshold, a transfer voltage derived using the setting current and the voltage detected by the second detector is supplied to the transfer unit.

2. The transfer apparatus according to claim 1, wherein the controller configured to control the supplying unit such that, when next transfer is performed after toner images are consecutively transferred onto a plurality of respective objects onto which transfer is performed, the transfer voltage derived using the setting current and the voltage detected by the second detector is supplied to the transfer unit.

3. The transfer apparatus according to claim 2, wherein the non-transfer period is a non-transfer period before toner images are consecutively transferred onto a plurality of respective objects onto which transfer is to be performed.

4. The transfer apparatus according to claim 1, wherein the non-transfer period is a non-transfer period before the next transfer of a toner image after toner images are consecutively transferred onto a plurality of respective objects onto which transfer is performed.

5. The transfer apparatus according to claim 1, wherein the non-transfer period is a non-transfer period before toner images are consecutively transferred onto a plurality of respective objects onto which transfer is to be performed.

6. An image forming apparatus comprising:

an image carrier;

a charging unit configured to charge the image carrier;

a forming unit configured to form an electrostatic latent image by exposing the image carrier charged by the charging unit to light;

a developing unit configured to develop, using toner, the electrostatic latent image formed on the image carrier by the forming unit; and the transfer apparatus according to claim 1.

7. A non-transitory computer readable medium storing a program causing a computer to execute a process, the process comprising:

controlling a transfer unit to transfer a toner image onto an object onto which transfer is to be performed;

controlling a first detector to detect humidity;

controlling a supplying unit to supply a transfer voltage to the transfer unit, and to supply a setting voltage to the transfer unit in a case Where the humidity detected by the first detector is less than or equal to a threshold in a non-transfer period before the toner image is transferred onto the object onto which transfer is to be performed, and to supply a setting current ina case where the humidity detected by the first detector exceeds the threshold in the non-transfer period;

controlling a second detector to detect a current flowing through the transfer unit in response to supply of the setting voltage and to detect a voltage generated across the transfer unit in response to supply of the setting current; and controlling the supplying unit such that, when transfer is performed in a case where the humidity detected by the first detector is less than or equal to the threshold, a transfer voltage derived using the setting voltage and the current detected by the second detector is supplied to the transfer unit, and when transfer is performed in a case where the humidity detected by the first detector exceeds the threshold, a transfer voltage derived using the setting current and the voltage detected by the second detector is supplied to the transfer unit.

* * * * *